United States Patent [19]

Friant et al.

[11] 4,000,696

[45] Jan. 4, 1977

[54] CARTRIDGE FOR TWO COMPONENT FIELD MIXED EXPLOSIVE

[75] Inventors: James E. Friant; William J. Bruton, both of Renton; Viggo C. Bertelsen, Jr., Bellevue, all of Wash.; Patrick A. Yates, Ridgecrest, Calif.

[73] Assignee: Excoa, Inc., Redmond, Wash.

[22] Filed: Sept. 5, 1975

[21] Appl. No.: 610,674

[52] U.S. Cl. ..... 102/24 R; 102/DIG. 9

[51] Int. Cl.[2] ..... F42B 3/02

[58] Field of Search ..... 102/22–24, 102/DIG. 9

[56] References Cited

UNITED STATES PATENTS

| | | | |
|---|---|---|---|
| 3,185,091 | 5/1965 | Hamilton | 102/24 R |
| 3,395,642 | 8/1968 | Foster et al. | 102/24 R |
| 3,926,119 | 12/1975 | Hurst | 102/DIG. 9 |

*Primary Examiner*—Verlin R. Pendegrass

*Attorney, Agent, or Firm*—Graybeal, Barnard & Uhlir

[57] ABSTRACT

An explosive cartridge for use in an explosive column train by end to end coupling of a plurality of cartridges. Each cartridge comprises a cylindrical containing shell having an open rear end in which is a closure plug. In the pre-mix condition, the cartridge contains a first solid component of a two part explosive. In field use the closure plug is removed and a liquid second explosive component is poured into the cartridge and the plug reinserted to form a sliding watertight seal with the cartridge. When several of the cartridges are joined in end to end relationship to form the explosive train, the nose end of one cartridge moves the plug of the adjacent forward cartridge inwardly to take up the slump in the explosive composition and maintain the closure plug seal.

7 Claims, 8 Drawing Figures

FIG. 2
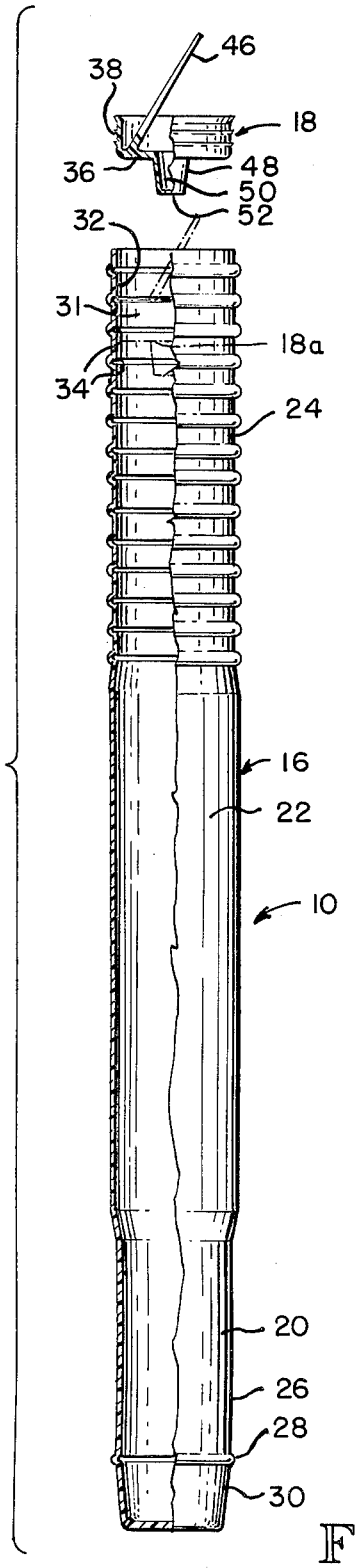
FIG. 1
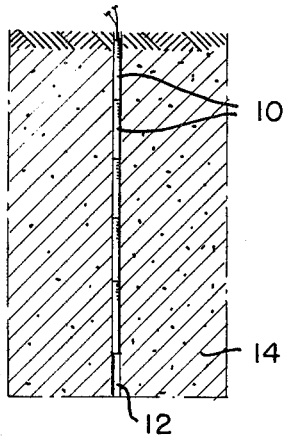
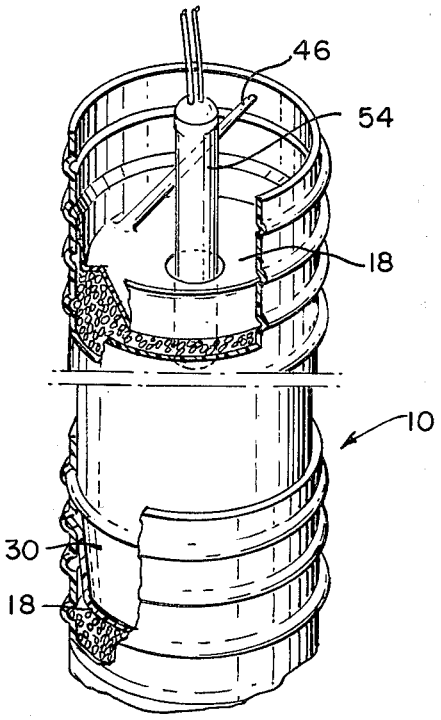
FIG. 3
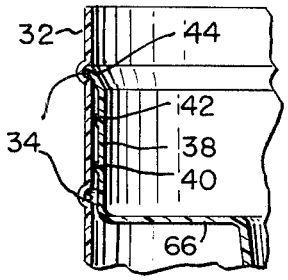
FIG. 4
FIG. 5B
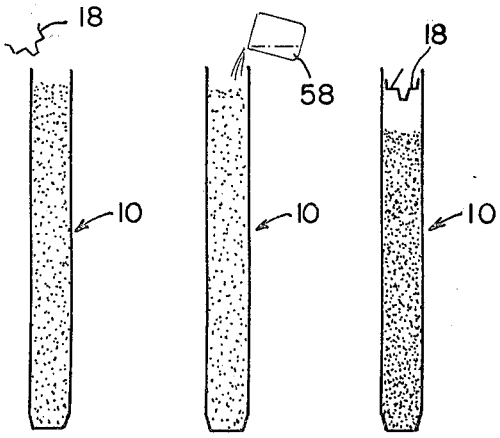
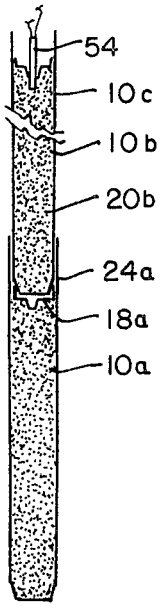
FIG. 5A FIG. 5C FIG. 5D

CARTRIDGE FOR TWO COMPONENT FIELD MIXED EXPLOSIVE

BACKGROUND OF THE INVENTION

1. Field of the Invention

The present invention relates to an explosive cartridge for use in an explosive column train, the cartridge being especially adapted for a two component explosive composition.

2. Description of the Prior Art

One prior art method of placing an explosive composition into a borehole is by use of a plurality of explosive containing cartridges placed in end to end relationship to form a columnar explosive train. The usual method of coupling the cartridges one to another is to provide the nose and tail end of each cartridge with male and female threads, respectively, and to screw the cartridges together. Such an arrangement is shown in U.S. Pat. No. 3,246,602, Meredith et al. In this patent, the tail end of each cartridge is provided with a closure member inserted into a tapered throat section at the rear of the cartridge. As one cartridge is screwed into engagement with another, the nose end of the rear cartridge wedges the closure member tightly into the throat section to form a watertight seal, so that water in the borehole will not be able to enter the cartridge and desensitize the explosive.

However, when a two component field mixed explosive is used in an explosive train, particular problems are encountered. Quite commonly, in two component field mixed explosives, there is a first solid component, made up of granules of nitrate or perchlorate compounds, and a second liquid component which is generally an organic sensitizer or a chemically activating liquid. Such explosive compositions are easily desensitized by water. Also, when the liquid component is added to the solid component, there is generally a substantial "slump" (i.e. a reduction in volume of the solid component, which can be up to as high as 25% of the initial volume, depending upon the composition and the granule size of the solid component). Such slump can be minimized by using a finer grain size of the solid oxidizer, but this in turn inhibits field mixing of the two components. When the several cartridges are joined in end to end relationship, this slump must be taken up in a manner to eliminate an air gap between the explosive charges of the several cartridges, to ensure detonation throughout the entire explosive column. The use of light flexible cartridges which can take up slump simply by deforming to a smaller volume has not been entirely satisfactory since the packages are sometimes too weak to resist puncture when slid into a borehole. On the other hand, the cartridges known to the applicants herein which are made of a harder, more puncture resistant material have not adequately solved the problem of mantaining a proper seal between the cartridges, while permitting allowance for such slump to ensure adequate proximity of the explosive charges of the several cartridges.

Thus, it is an object of the present invention to provide an effective explosive cartridge especially adapted for use in an explosive column train, where a field mix, two component explosive composition is used.

SUMMARY OF THE INVENTION

The present invention comprises an explosive containing cartridge for use in an explosive column train where a plurality of such cartridges are coupled in end to end relationship, each cartridge being especially adapted for field mix of a two component composition.

The cartridge comprises a generally cylindrical containing shell to contain a first solid component of the explosive composition. The shell has an open tail end portion defining a substantially non-tapering cylindrical recess, and a closed front nose end portion having a substantially non-tapering cylindrical outer surface adapted to slide axially into a tail end of an adjacent forwardly located cartridge. One end of the cartridge is provided with protruding circumferential ridges and the other provided with circumferential grooves to enable the cartridges to be coupled in end to end relationship.

Fitting in the recess at the tail end of each cartridge is a closure plug initially positioned at a rear pre-mix position in the shell and providing a watertight seal. The plus is moveable forwardly in the recess in snug sliding relationship from the rear pre-mix position into a forward post-mix position where it also forms a watertight seal with the shell. The preferred means of forming such a seal is to provide the closure plug with a cylindrical seal surface having a plurality of circumferential ridges having an axial spacing dissimilar to circumferential grooves formed in the tail end portion of the shell. Thus when one of the ridges of the closure member fits into a groove in the shell, one or more other ridges on the plug are pressed against the side wall of the shell recess to provide a watertight seal.

The transverse surface of the closure plug has a preformed opening closed by a membrane which can be pushed open by insertion of a cylindrical detonator. This opening is sized relative to the detonator so that the moderately flexible side wall forming the opening grips the detonator with sufficient pressure to form a watertight seal.

The cartridge in its pre-mixed condition contains the solid first explosive component, with the closure plug positioned at the rear of the tail end recess of the cartridge shell. When the cartridge is to be used, the plug is removed, the liquid second component is poured into the open end of the cartridge shell to mix with the solid first component, and the plug is reinserted. This procedure is followed for each of the several cartridges which are to make up the explosive train. As the nose end of one cartridge is inserted into the tail end of a forward cartridge, the nose end of the rear cartridge pushes the closure plug of the forward cartridge further into the non-tapered recess of the shell until the plug bottoms out against the mixed explosive composition, with the plug maintaining its watertight seal with the shell. After the last cartridge is in place, the detonator is pushed through the membrane of the presealed opening of the plug of the rearmost cartridge into detonating relationship with the explosive composition contained therein. In this condition, each of the cartridges is sealed from any water that may be in the borehole, and the explosive in each of the cartridges is positioned sufficiently close to the explosive in the adjoining cartridges to ensure detonation throughout the explosive column.

BRIEF DESCRIPTION OF THE DRAWING

FIG. 1 is a sectional view illustrating several cartridges of the present invention positioned in a borehole and connected one to another to form an explosive column train;

FIG. 2 is a longitudinal view, partly in section, illustrating the cartridge of the present invention;

FIG. 3 is an isometric view of the tail end portion of the cartridge of FIG. 2, with a detonator positioned in the end closure plug of the cartridge;

FIG. 4 is a longitudinal section view illustrating adjoining wall portions of the closure plug and tail end portion of the cartridge shell, to illustrate the manner in which the ridges and grooves of these components interfit; and FIGS. 5A through 5D are semi-schematic illustrations showing the method of field mixing the explosive composition in the cartridge of the present invention.

DESCRIPTION OF THE PREFERRED EMBODIMENT

In FIG. 1, there is shown a plurality of cartridges 10 of the present invention connected in end to end relationship to form an explosive train, and positioned in a borehole 12 in a ground formation 14. Each cartridge 10 comprises an elongate generally cylindrical shell 16 and an end closure plug 18. Both the shell and plug 18 are made of a rugged, moderately deformable material, such as polyethylene having a wall thickness of approximately .025 inch.

Each shell 16 has a front nose portion 20, a middle body portion 22, and a tail end portion 24. The nose portion 20 has a cylindrical, non-tapered side wall 26 having at its forward end a circumferential ridge 28 for interconnection with another forwardly positioned cartridge. The extreme forward end of the nose portion 20 is moderately beveled, as at 30, to facilitate insertion of the nose portion 20 into the tail end 24 of an adjacent cartridge 10.

The tail end portion 24 has a cylindrical, non-tapered configuration, defining a non-tapering cylindrical recess 31 having an inside diameter approximately the same as the outside diameter of the nose side wall 26. The inside surface 32 of the tail end 24 is formed with a plurality of evenly spaced circular grooves 34, each of which lies in a plane perpendicular to the longitudinal axis of the shell 16. Thus when the nose portion 20 of an adjacent cartridge 10 is inserted into the tail end 24 of an adjacent cartridge 10, the side wall 26 of the nose 20 fits snugly inside the tail end 24 of the adjacent cartridge, with the ridge 28 on the nose portion 20 seating in one of the grooves 34 of the tail end portion 24 of the adjacent cartridge 10 to make a mechanical connection.

The end plug 18 of the cartridge 10 is integral and is made up of a transverse circular closure plate 36 and a circumferential cylindrical side wall 38 extending rearwardly from the circumferential edge of the plate portion 36. The side wall 38 is formed with a plurality of circumferential ridges which are shown herein as a forward ridge 40, an intermediate ridge 42 and a rear ridge 44. The rear ridge 44 is conveniently formed as an outwardly flared rearwardly extending lip, while the other two ridges 40 and 42 are circumferential protrusions formed in the side wall 38. In its normal pre-mix position, the plug 18 is positioned in the rear of the tail end 24 of the shell 16. So that the plug 18 can be withdrawn from the shell 16 for insertion of the liquid second explosive component, a pulltab 46 is connected to the rear surface of the plate portion 36 of the plug 18.

At the center of the plate portion 36 of the plug 18, there is a forwardly extending tubular member 48 of relatively short axial length defining an axially aligned opening 50, the forward end of which is closed by a breakable membrane 52. The diameter of the tubular member 48 is substantially smaller than that of the plug 18, and the opening 50 is sized so that a detonator, illustrated at 54, of a predetermined diameter can be pushed into the opening 50 and fit in snug sealing relationship with the tubular member 48. The tubular member 48 tapers inwardly to a moderate extent in a forward direction so that the forward portion of the tubular member 48 grips the detonator 54 with sufficient pressure to form a watertight seal therewith.

Of particular significance in the present invention is the manner in which the closure plug 18 cooperates with its shell 16 to enable the use of a two component field mixed explosive. In the pre-mix condition, the shell 16 is filled almost to the extreme end of its tail portion 24 with granules of the solid first component of the explosive composition, with the closure plug 18 being positioned in the rear end of the shell tail portion 24. The plug 18 in its closure position is illustrated in dotted lines at 18*a* in FIG. 2.

In this position, the plug 18 forms a watertight seal with the shell 16. To illustrate this more clearly, reference is now made to FIG. 4, which shows to an enlarged scale the matching ridges and grooves of the plug 18 and shell rear portion 24. It will be noted that the grooves 34 of the shell tail end portion 24 are uniformly spaced axially approximately 0.30 inches apart. The spacing of the three ridges 40, 42 and 44 along the side wall 38 of the plug 18 are less than that of the grooves 34 and unequally spaced so that if one of the ridges 40, 42 and 44 fits in a related groove 34, the other two of the ridges 40, 42 and 44 do not fit in a groove 34 but press against the inner surface 32 of the side wall that forms the tail end portion 24. Thus, while one ridge 40, 42 or 44 provides a mechanical interconnection between the plug 18 and the shell 16, the other two of the ridges 40, 42 and 44 press against the interior surface 32 of the tail end portion 24 with sufficient pressure to form a watertight seal. Also the dissimilar spacing of the ridges and grooves permits the plug 18 to be mechanically secured in place at selected locations spaced much closer than the spacing of the grooves 34, simply by sliding the plug 18 forwardly a short distance so that another ridge 40, 42 or 44 comes into engagement with a groove 34.

Reference is now made to FIGS. 5A through 5D. At the site of use, the plug 18 of each cartridge 10 is pulled out of the shell 16 by means of the pulltab 46, as illustrated in FIG. 5A. Then, as illustrated in FIG. 5B, the liquid second explosive component, indicated at 58, is poured into the open end of the shell 16. As the liquid component 58 combines with the solid component 56, there is generally a "slump" or reduction in volume of the combined explosive composition. This is generally in the order of 10% to 25%, depending upon the explosive composition used, the granule size of the solid component, and a number of other factors. As illustrated in FIG. 5C, the plug 18 is then reinserted into the tail end 24 of the shell 16. This same procedure is followed for each of the cartridges 10 to be used in the explosive column train.

A second cartridge (designated 10*b* in FIG. 5D) is coupled in end to end relationship with the first cartridge 10*a* by placing the nose end 20*b* of the cartridge 10*b* into the tail end 24*a* of the cartridge 10*a*. As the two cartridges 10*a* and 10*b* are pushed together, the closure plug 18*a* of the first cartridge 10*a* is pushed down into the tail end portion 24*a* until it bottoms out on the mixed explosive composition in the cartridge 10*a*. As indicated above with reference to FIG. 4, the ridges 40, 42 and 44 of the plug 16*a* provide a mechanical interconnection of the plug 18*a* in its shell 16*a* and also a watertight seal. With the non-tapered configuration of the recess 31, this seal is adequately maintained along the entire length of the recess 31. Also, as indicated above, the ridge 28 on the nose portion 20*b* of cartridge 10*b* mechanically interconnects with a matching groove 34 in the tail end portion 24*a* of the cartridge 10*a*.

In like manner, other cartridges 10 can be connected to the first two cartridges 10*a* and 10*b* to form the explosive column train. After the final cartridge is put in place, a portion of which is shown at 10*c* in FIG. 5D, the detonator 54 is inserted into the plug opening 50 and pushed through the membrane 52 to extend into the explosive composition in the cartridge 10*c*. In this condition, the explosive column train, made up of a plurality of cartridges 10, can be inserted into a borehole, as illustrated in FIG. 1. Each cartridge 10 is sealed to prevent any water from desensitizing the explosive. Also, the explosive charges in each of the cartridges 10 are in close proximity to one another so that when the detonator 54 is activated, the explosion proceeds throughout the explosive train.

An explosive composition suitable for use in the present invention is that described in U.S. Pat. No. 3,768,410. In that patent, the solid component is granules or prills of ammonium nitrate, and the liquid component is a solution of hydrazine and water. These are mixed in the proportion of 10 parts of the solid component to approximately 1 part of the liquid component, and in some instances less than 1 part of the liquid component to 10 parts of the solid component.

What is claimed is:

1. An explosive cartridge particularly adaptable to a field mix two component explosive composition, which cartridge is arranged to be coupled with other like cartridges to form an explosive column train by end to end coupling of the cartridges, said cartridge comprising:

a. a cylindrical containing shell to contain a first solid component of said explosive composition, said shell having:

1. an open tail end portion defining a substantially non-tapering cylindrical recess,
2. a closed front nose portion having a substantially non-tapering cylindrical outer surface portion adapted to slide axially into a tail end portion of an adjacent forwardly located cartridge,
3. said end portions being provided with circumferential matching ridge and groove means to provide mechanical interconnection of a pair of adjacent cartridges, b. a cylindrical end closure plug adapted to fit within the non-tapering recess of its related cartridge in sealing relationship therewith, and moveable axially in snug sliding relationship a substantial axial length of the tail portion of its related shell from a rearward pre-mix position to a forward post-mix position, c. said plug and tail end having non-matching ridge and groove means so as to provide a mechanical interconnection therebetween by at least one engaging ridge and groove, and providing a seal therebetween by means of a non-matching portion of the ridge and groove means, whereby said plug and shell form a watertight seal in both post-mix and pre-mix conditions, and said plug can be moved axially in said shell while maintaining a proper seal to accomodate post-mix slump of the explosive composition.

2. The cartridge as recited in claim 1, wherein said nose portion has at least one circumferential connecting ridge, said tail portion has a plurality of circumferential grooves, and said plug has a plurality of circumferential ridges having an axial spacing not matching that of said grooves.

3. The cartridge as recited in claim 2, wherein said plug has a presealed opening defined by a moderately resilient material, said opening being adapted to accommodate a detonator in sealing relationship with the material defining the opening.

4. The cartridge as recited in claim 3, wherein said presealed opening is defined by an axially extending tubular member having a membrane closing one end thereof, with the tubular member being adapted to grip a detonator.

5. The cartridge as recited in claim 1, wherein said plug has a presealed opening defined by a moderately resilient material, said opening adapted to accommodate a detonator in sealing relationship with the material defining the opening.

6. The cartridge as recited in claim 5, wherein said presealed opening is defined by an axially extending tubular member having a membrane closing one end thereof, with the tubular member being adapted to grip a detonator.

7. The cartridge as recited in claim 1, wherein said plug has a plurality of circumferential ridges having an axial spacing moderately less than the grooves in the tail end portion on the shell, whereby when one of said ridges is located in a groove, other of said ridges form a watertight seal.

* * * * *